United States Patent [19]

Böhmer et al.

[11] 4,036,483

[45] July 19, 1977

[54] BLAST-FURNACE LINING ARRANGEMENT

[75] Inventors: Eberhard Böhmer, Heilshorn; Wilhelm Hüsch, Bremen-Aumund, both of Germany

[73] Assignee: Klöckner-Werke AG, Duisburg, Germany

[21] Appl. No.: 664,809

[22] Filed: Mar. 8, 1976

[30] Foreign Application Priority Data

Mar. 12, 1975 Germany ..... 2510628

[51] Int. Cl.[2] ..... C21B 7/06

[52] U.S. Cl. ..... 266/281

[58] Field of Search ..... 266/197, 198, 199, 280, 266/281, 287; 254/190 R

[56] References Cited

U.S. PATENT DOCUMENTS

| | | | |
|---|---|---|---|
| 3,804,371 | 4/1974 | Mills et al. | 254/190 R |
| 3,866,382 | 2/1975 | Van Tassel | 266/281 |

FOREIGN PATENT DOCUMENTS

| | | | |
|---|---|---|---|
| 1,154,131 | 9/1963 | Germany | 266/281 |
| 1,458,895 | 2/1969 | Germany | 266/281 |

*Primary Examiner*—Gerald A. Dost
*Attorney, Agent, or Firm*—Michael J. Striker

[57] ABSTRACT

An arrangement for lining a blast furnace of varying inner dimensions includes a working platform which can be adjusted in its transverse dimensions to the inner dimensions of the blast furnace at any particular elevation of the same. The working platform is lifted to different elevations within the blast furnace by a plurality of tackles which are mounted on the working platform and at a region of the blast furnace which is located upwardly of the working platform. The working platform includes a central portion and a plurality of support elements which are mounted in the central portion for telescopic displacement relative thereto toward and away from the inner surface of the blast furnace, and a plurality of floor elements is interchangeably and detachably supported on the support elements when the latter are in their at least partly telescoped-out position. A conically downwardly diverging sleeve is located underneath the working platform and communicates with an opening of the working platform through which lining material is supplied to the latter.

12 Claims, 8 Drawing Figures

BLAST-FURNACE LINING ARRANGEMENT

BACKGROUND OF THE INVENTION

The present invention relates to an arrangement for lining blast furnaces.

It is well known that a blast furnace has an inner lining of refractory material which is to be repaired or replaced from time to time as the old refractory lining becomes worn out. For this purpose, it is already known in the prior art to erect a scaffolding in the interior of the blast furnace which is generally similar to such scaffoldings which are used in the construction industry. Such conventional scaffolding includes a plurality of supporting and connecting elements, such as beams and struts, and a plurality of working platforms which are supported on the support and connecting elements.

A multitude of problems is encountered when such conventional scaffolding of a stationary nature is used for the purpose of removing the worn-out lining of refractory material and replacing the same by a new lining. First of all, it is well known that the shaft or stack section of the blast furnace, on the one hand, and the bosh section, on the other hand, has generally frusto-conical configurations with the imaginary frusto-cones converging from an imaginary basis. Thus, the transverse inner dimensions of the blast furnace vary in dependence on the elevation within the blast furnace. The conventional stationary scaffolding must take this variation in the inner dimensions of the blast furnace into account. For this purpose, the stationary scaffolding is equipped with cantilevered support portions at different levels of the scaffolding, which cantilevered support portions extends all the way toward the inner surface of the refractory lining. In this manner the varying inner dimensions of the blast furnace are taken into consideration in a stepwise manner.

The stationary scaffolding of the prior art surrounds a shaft for an elevator which lifts the lining material, such as refractory bricks, needed for the construction of the refractory lining, to the different levels of the scaffolding. The refractory material is usually introduced into the interior of the blast furnace through an opening which is provided in the jacket of the hearth, being supported on pallets.

In view of the fact that blast furnaces have heights of up to 40 meters or more, the scaffoldings used for lining the interior of such blast furnaces must be constructed as a grid of the supporting and connecting elements which includes a multitude of such elements at relatively small spacing from one another, which elements must be anchored at many locations. As a result of this tight-grid construction of the scaffoldings, the interior space of the blast furnace, which is relatively small as it is, is further reduced.

Another disadvantage of this prior-art approach is that the erection of the stationary scaffolding consumes an inordinate amount of time, such as several days, and must be performed with a high degree of skill. Similar considerations are also valid for dismounting the scaffolding subsequent to the construction or reconstruction of the refractory lining.

A further disadvantage of the stationary scaffolding is to be seen in the fact that, prior to the construction of the new refractory linings, the old and worn-out refractory lining must be removed all the way to the blast furnace jacket. The removed old refractory lining ideally falls into the hearth of the blast furnace and is removed therefrom through a lateral opening, which is later closed, but which is used before such closing also for introduction of the new refractory material into the interior of the blast furnace. In practice, however, the larger part of the removed old refractory lining falls into the scaffolding and onto the platform located at various levels thereof. This, of course, is very disadvantageous, particularly in view of the danger that the scaffolding may be damaged by the impacts of the old lining particles thereupon. On the other hand, bulky parts of such old refractory material may become lodged between the inner wall of the blast furnace and the various supporting and connecting elements of the scaffolding and must be removed therefrom, in a very difficult and time-consuming operation, by the personnel working on the scaffolding. As a result of these disadvantages and of the difficult working conditions attendant thereto, a time span of several weeks is generally needed for removal of the old, worn-out refractory lining, whereas approximately the same time span is needed for constructing the new refractory lining. This, of course, is in addition to the time period which is needed for the mounting and dismounting of the scaffolding, which time period may also take up to several weeks.

SUMMARY OF THE INVENTION

It is a general object of the present invention to avoid the disadvantages of the prior art.

More particularly, it is an object of the present invention to provide an arrangement for lining blast furnaces which significantly reduces the time which is needed for constructing a refractory lining in the interior of the blast furnace.

A further object of the present invention is to provide an arrangement of the type here under consideration which is simple in construction and reliable in operation.

A concomitant object of the present invention is to provide such an arrangement which allows for rapid progress of work connected with constructing a replacement refractory lining in the interior of the blast furnace.

Yet another object of the present invention is to provide an arrangement which can be used for removal of worn out refractory lining of a blast furnace, as well as for construction of a replacement lining.

In pursuance of these objects and others which will become apparent hereafter, one feature of the present invention resides, briefly stated, in an arrangement for lining a blast furnace of varying inner dimensions which comprises a working platform; means for lifting the working platform to different elevations within the blast furnace; and means for adjusting the transverse dimensions of the working platform to the inner dimensions of the blast furnace at any particular elevation of the same. The provision of the liftable working platform in the interior of the blast furnace avoids the heretofore existing need for erecting a conventional scaffolding in the relatively limited interior space of the blast furnace. A further advantage of this arrangement is to be seen in the reduction of the previously needed time periods for erecting and dismounting the conventional stationary scaffolding. The liftable working platform replaces the conventional stationary scaffolding, which working platform can be continuously moved between a plurality of different elevations relative to the blast furnace.

The working platform affords the advantage that the transverse dimensions thereof can be practically steplessly adjusted to the varying inner dimensions of the blast furnace. Generally speaking, the working platform could be so constructed that the dimensions thereof could be continuously adjusted to the varying inner dimensions of the blast furnace. However, in practice, it is sufficient to adjust the dimensions of the working platform in a stepped manner, the stepped adjustment being so finely divided that the working personnel can always be positioned at a convenient distance from the inner wall of the blast furnace. On the other hand, when the working platform is used for breaking-away the old, worn-out refractory lining of the blast furnace, a sufficiently wide gap is left between the inner surface of the lining of the blast furnace and the working platform, so that the broken-away parts of the old lining can fall through the gap into the hearth.

Preferably, the adjusting arrangement for the adjustment of the transverse dimensions of the working platform is so constructed that even irregular variations in the inner dimensions of the blast furnace can be taken into consideration. This is particularly advantageous in view of the fact that, more often than not, the refractory lining which is to be removed may be damaged to different extents in different regions of the blast furnace, even at the same elevation. This is achieved, according to the invention, by constructing the adjusting arrangement in a plurality of sections, and by displacing the various sections relative to the working platform toward the inner surface of the blast furnace independently of the extent of displacement of the other sections of the adjusting arrangement.

In principle, it would be possible to construct the lifting arrangement for lifting the working platform as a telescoped-together support column or a plurality of such support columns which would be arranged in the hearth portion of the blast furnace. However, if the arrangement for lifting the working platform were constructed in this manner, the column or the columns could be damaged during the breaking-away of the worn-out refractory lining, so that this type of lifting arrangement could only be used or recommended for use during the construction of a new refractory lining. In order to avoid this drawback of the telescoped-together lifting arrangement located underneath the working platform, the present invention takes a different approach to the construction of the lifting arrangement and provides the same in the space above the working platform. According to a currently preferred embodiment of the present invention, the lifting arrangement includes a plurality of tackles which are mounted on the working platform and at a region of the blast furnace which is located above the working platform, in most instances even above the portion of the blast furnace which is to be provided with the refractory lining. The lifting arrangement further includes a plurality of winches which are arranged in such region of the blast furnace. When these measures are taken, that is, when the lifting arrangement for the working platform is arranged in its entirety in the space above the working platform, the space underneath the working platform is completely free and available for accommodating the broken-away old refractory lining, so that parts of the old refractory lining are free to fall into the hearth and can be subsequently removed through the lateral opening of the hearth jacket.

In a currently preferred embodiment of the present invention, the working platform includes a central portion and the adjusting means includes a plurality of support elements which are mounted in the central portion for telescopic displacement relative thereto toward and away from the inner surface of the blast furnace. The adjusting arrangement then further includes a plurality of floor elements which are interchangeably and detachably supported on the support elements when the latter are in their at least partly telescoped-out positions. The central portion of the working platform preferably is of a circular configuration and has a diameter which approximately corresponds to the smallest inner diameter of the blast furnace. On the other hand, the central portion of the working platform is so dimensioned that it can be introduced into the interior of the blast furnace through the lateral opening provided in the hearth jacket of the blast furnace. When the elevation of the working platform is changed, either by lifting the platform or by lowering the same, the support elements are telescoped in or out of the central portion of the working platform up to the inner surface of the blast furnace, and the floor elements are subsequently located on the support elements. Furthermore, the floor elements can be connected with the floor portion of the central portion of the working platform and thus secured against shifting movements due to differential loading of the platform and different forces acting on the floor elements thereof.

In a further currently preferred embodiment of the present invention, the central portion of the working platform is formed with an opening which serves the purpose of supplying the lining material and various tools which are needed on the platform from the hearth portion of the blast furnace through the top surface of the working platform. The supply of such material or tools is accomplished, for instance, by means of an elevator which is supported in the upper portion of the blast furnace.

In view of the fact that it is impossible to fully exclude the possibility that the pallets on which the lining material is supplied to the working platform will conduct angular movements as they are lifted toward and through the opening of the central portion of the working platform, it is proposed according to a further advantageous concept of the present invention to provide a guide sleeve underneath the working platform, which guiding sleeve surrounds the opening of the central portion of the working platform. Advantageously, the guide sleeve diverges in downward direction in a conical fashion and bounds a guide passage of frusto-conical configuration through which the lining material is supplied to the opening of the central portion of the working platform. In this manner, it is avoided that the pallet which supplies the material to the working platform could become caught underneath the working platform, even if the pallet conducts angular or swinging movements during the lifting thereof toward the opening of the central portion of the working platform. Advantageously, the guide sleeve is of an elastic material so that, even if the guiding sleeve is repeatedly hit by the pallets passing therethrough, it is not damaged thereby but rather resiliently reassumes its original shape.

The novel features which are considered as characteristic for the invention are so set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
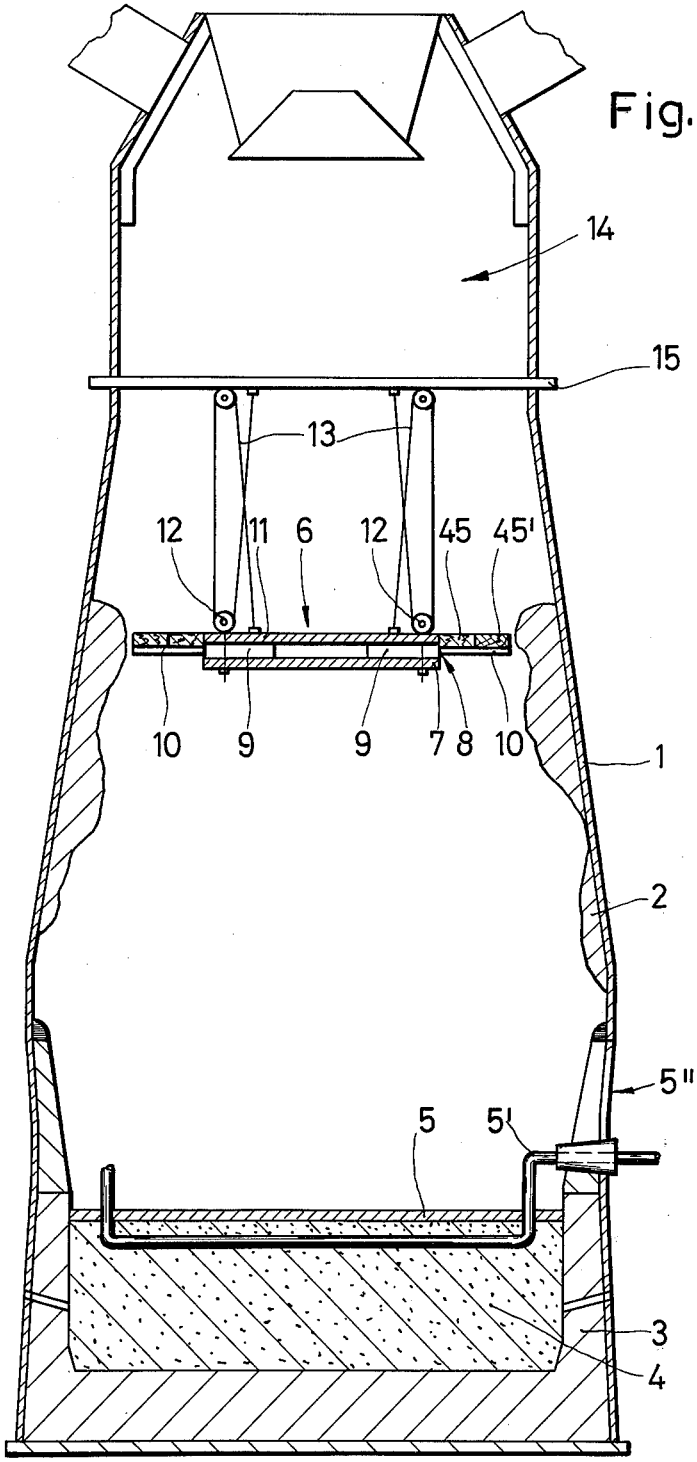
FIG. 1 is a somewhat diagrammatic sectional view of a blast furnace illustrating a first embodiment of the arrangement of the present invention.

Referring now to the drawings, and first to FIG. 1 thereof, it may be seen that this Figure illustrates a sectional view of a blast furnace after the same has been taken out of operation and the lining has been partly removed.

The reference numeral 1 designates the outer jacket of the blast furnace, and old, worn-out refractory lining 2 is shown as being located at the inner surface of the blast furnace jacket 1. For purposes of illustration, the wear of the lining 2 has been exaggerated. The furnace, such as a blast furnace, further includes a hearth 3 which accommodates the remaining, still hot, burning waste 4. A concrete floor 5 covers the body of the burning waste 4, and a water cooling system 5′ is provided within or underneath the concrete floor 5. A lateral opening 5″ is provided in the jacket of the hearth 3, which opening 5″ has such dimensions that a working platform 6 can be introduced into the interior of the blast furnace therethrough. As will be disclosed in more detail later on, the working platform 6 includes a carrier frame 7 on which there are mounted supported elements 8. The support elements 8 include an outer part 9 and an inner part 10 which is received within and telescopically guided in the outer part 9. A floor 11 is supported on the support elements 8. The working platform 6 is equipped with several conventional parts of a lifting arrangement, such as hook-receiving armatures or pulleys 12 on which a rope is mounted or about which the same is trained, these parts being components of tackles 13 the other components of which are supported in the head portion 14 of the blast furnace. In order to support the other components of the tackle arrangement 13 in the head of the blast furnace, through openings are provided in the head portion 14 of the blast furnace, and support beams 15 are guided through and supported in the through openings. Then, the other components of the tackle arrangement, which are conventional in construction and in operation, are mounted on the beam 15.

The diameter of the carrying frame is so selected that the working platform 6, together with the carrying frame 7 thereof, can be introduced into the interior of the blast surface through the opening 5″, with the support elements 8 being in their fully retracted positions. The working platform 6 includes basically two regions. First of all, it includes a central portion which has such dimensions that it is flush with the free ends of the outer parts 9 of the support elements 8. The other region of the working platform 6 is obtained by displacing the inner parts 10 of the support elements 8 out of the outer parts 9 thereof, whereby the working platform 6 is extended in one or more directions.

Once the working platform 6 is properly positioned on the concrete floor 5, the necessary equipment is located upon, and the working personnel steps on the working platform 6, whereupon the tackle arrangement 13 lifts the working platform 6 toward higher regions of the interior of the blast furnace. When the working platform is properly lifted, the working personnel can start breaking away the old, worn-out refractory lining 2 so that the broken-away parts of the lining 2 can fall through a gap between the inner wall of the blast furnace and the working platform 6 into the hearth portion 3 from which it is subsequently removed through the opening 5″. The transverse dimension of the working platform 6 is varied by telescoping the inner parts 10 of the support elements 8 in and out of the outer parts 9 thereof, so that the transverse dimension of the working platform 6 always substantially corresponds to the transverse dimension of the blast furnace at the particular elevation.

Figure 2:
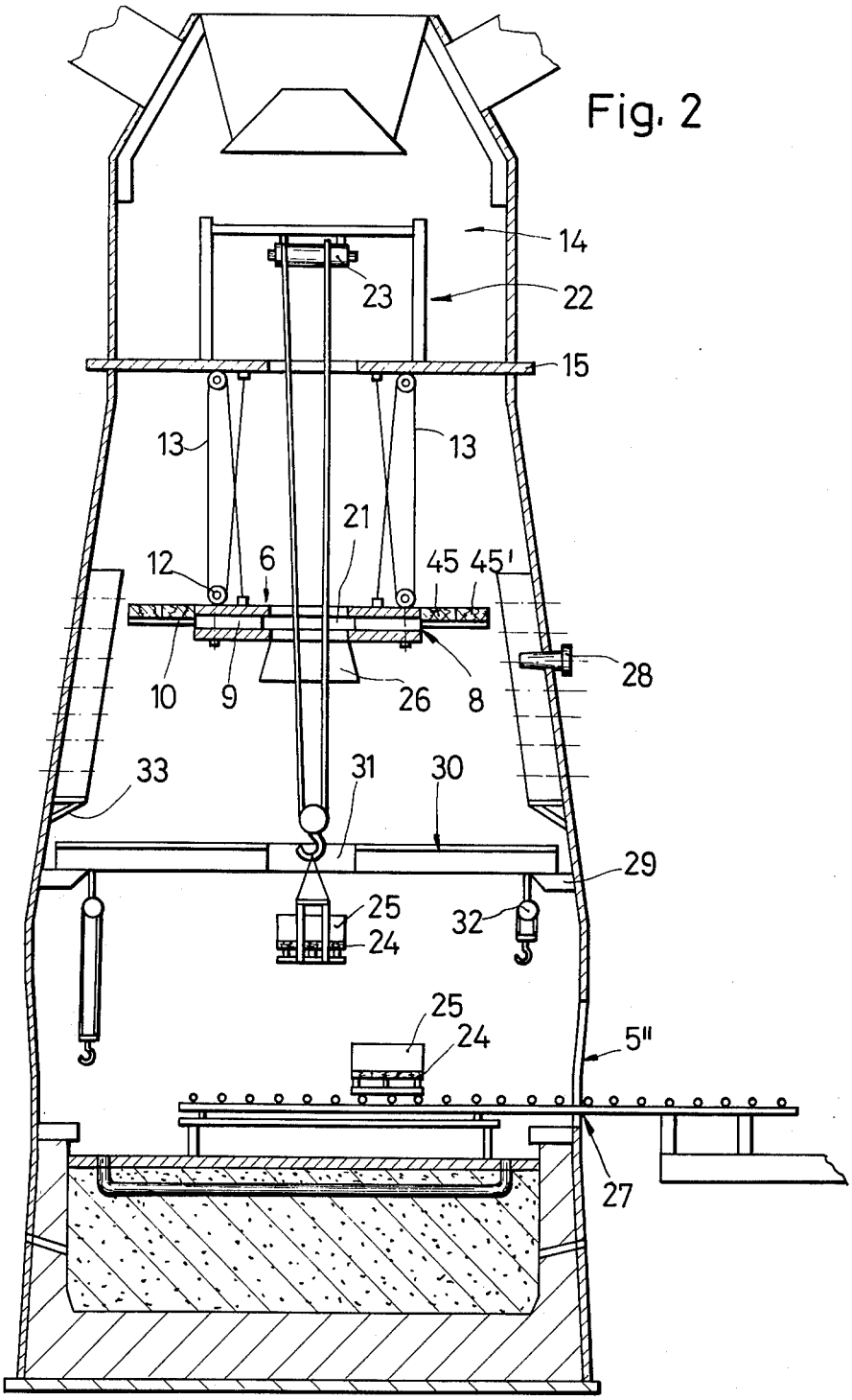
FIG. 2 is a view similar to FIG. 1 but illustrating a different embodiment of the arrangement of the present invention.

FIG. 2 illustrates a different example of an embodiment of the arrangement of the present invention, in which the blast furnace is illustrated in a somewhat diagrammatic manner in vertical section. Such parts which are similar in the embodiment of FIG. 2 to those of the embodiment of FIG. 1 are designated with the same reference numerals. In the embodiment of FIG. 2, the old, worn-out refractory lining 2 is already completely removed and a new refractory lining 20 is already partially constructed.

In contradistinction to the embodiment illustrated in FIG. 1, the working platform 6 is provided with an opening 21 through which the lining material is supplied to the top surface of the working platform 6. In order to achieve such material supply, a support 22 for a winch or windlass 23 is mounted on the transverse beam 15, the winch 23 serving the purpose of lifting the building blocks 25 of lining material which are arranged on pallets 24. The building blocks 25 are introduced into the blast furnace through the opening 5″, prior to lifting of such pallets 24. A guiding sleeve 26 of an elastically yieldable material, such as natural or synthetic rubber, is arranged underneath the working platform 6 and surrounds the opening 21, the guiding sleeve 26 conically diverging in the downward direction and preventing the possibly swinging pallets 24 from becoming caught underneath the working platform 6.

The building blocks 25 of refractory lining material are introduced into the interior of the blast furnace on the pallets 24 by means of a roller conveyor 27. The reference numeral 28 indicates cooling boxes which are embedded in the jacket of the blast furnace during the construction of the new lining 20.

In order to shorten the time which is needed for the construction of the refractory lining 20, FIG. 2 illustrates that the furnace can be subdivided in two working zones. For this purpose, support projections 29 are welded to the jacket of the blast furnace in the region of the bosh. An auxiliary working platform 30 is supported on the supports 29, which is provided with an opening 31. This essentially flat working platform 30 has a constant diameter which corresponds to the inner diameter of the blast furnace in the region of the supports 29. The auxiliary working platform 30 simultaneously serves the purpose of protecting the personnel which works underneath the same. Winches 32 are displaceably mounted on the lower sides of the working platform 30, which winches 32 serve the purpose of transporting the building blocks 25 in the lower working zone of the blast furnace. On the other hand, the opening 31 serves for supplying a part of the building blocks 25 which are supported on pallets 24 to the upper surface of the working platform 6 and thus into the upper working zone.

The jacket of the blast furnace is provided, in a region upwardly spaced from the working platform 30, with cantilevered supports 33 which serve as the lower supports for the lining which is constructed in the upper zone of the blast furnace. When the construction of the lining in the upper working zone is terminated, and when the lining in the lower working zone is erected to about the half height of the lower working zone, the protective auxiliary working platform 30 is removed and the construction of the lining of refractory material is completed, starting at the already constructed lower part of the lining. When the lining reaches the lower part of the upper portion of the lining, the cantilevered supports 33 are removed so that a unitary lining of the blast furnace is obtained.

Figure 3:
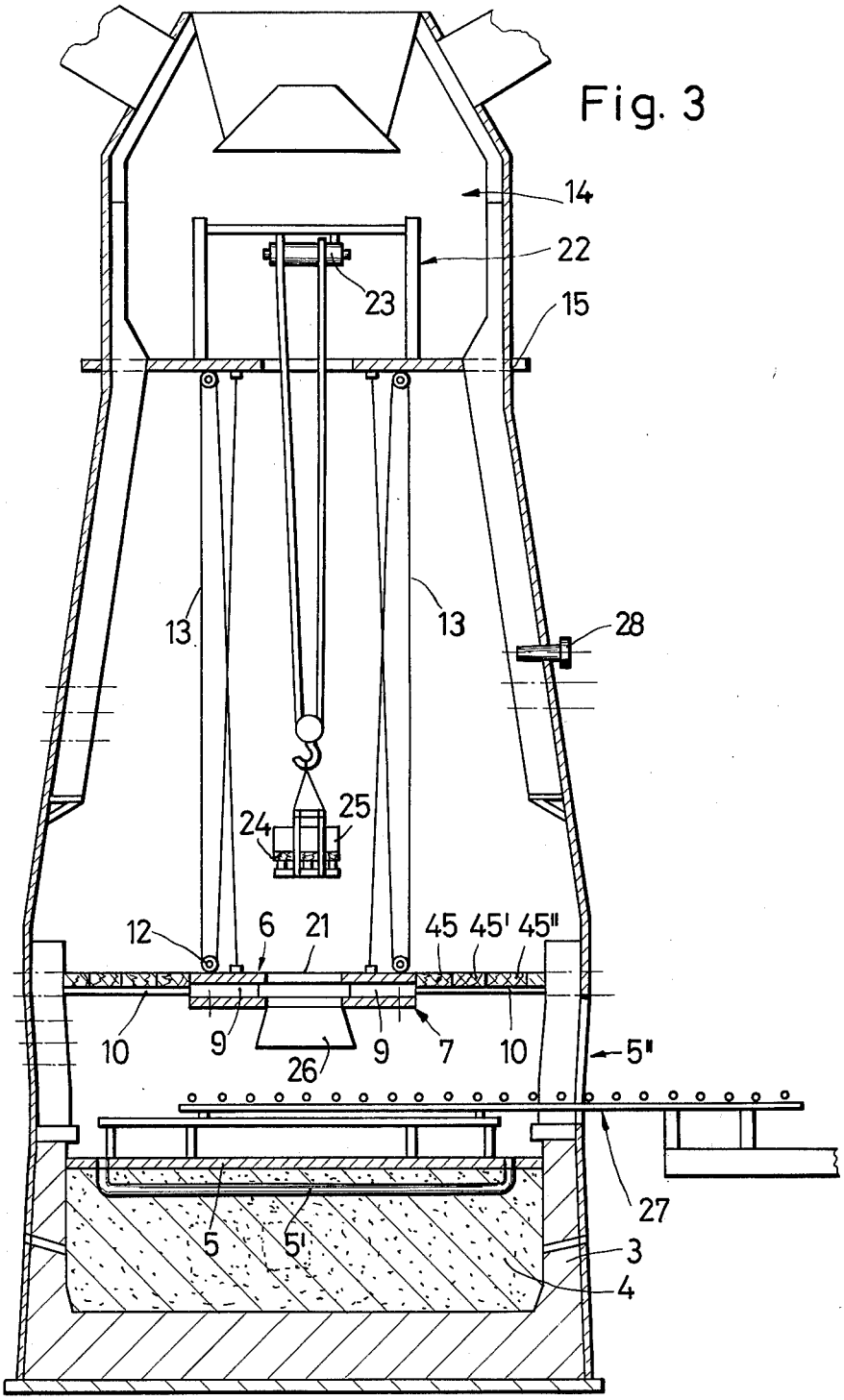
FIG. 3 is a view similar to FIG. 2 but during a different phase of use of the arrangement of the present invention.

This last phase in the construction of the lining is illustrated in FIG. 3. Accordingly, the arrangement which is illustrated in FIGS. 2 and 3 includes the liftable and radially adjustable working platform 6 and the protective working platform 30. If so desired, a plurality of the adjustable working platforms 6 can be combined with a plurality of stationary platforms 30 to obtain a complete arrangement for lining blast furnaces.

After the lining 20 has been constructed, the working platforms 6 and/or 30 are removed from the interior of the blast furnace, together with all other equipment which was needed during the construction of the lining, and the opening 5'' is closed, such as by erecting a masonry wall, preferably of refractory material, across the same. The succession of steps which has been discussed above in connection with the embodiments illustrated in FIGS. 1, 2 and 3 shows that a substantial time saving is achieved when the lining is constructed using the liftable working platform 6 and/or the stationary working platform 30 of the present invention, when compared to the prior-art scaffolding. In addition thereto, it is possible with the arrangement illustrated in FIGS. 2 and 3 to simultaneously work, that is to construct the lining, in different working zones of the blast furnace, and to significantly reduce the danger of injury to the personnel which works in the various working zones of the blast furnace.

Figure 4:
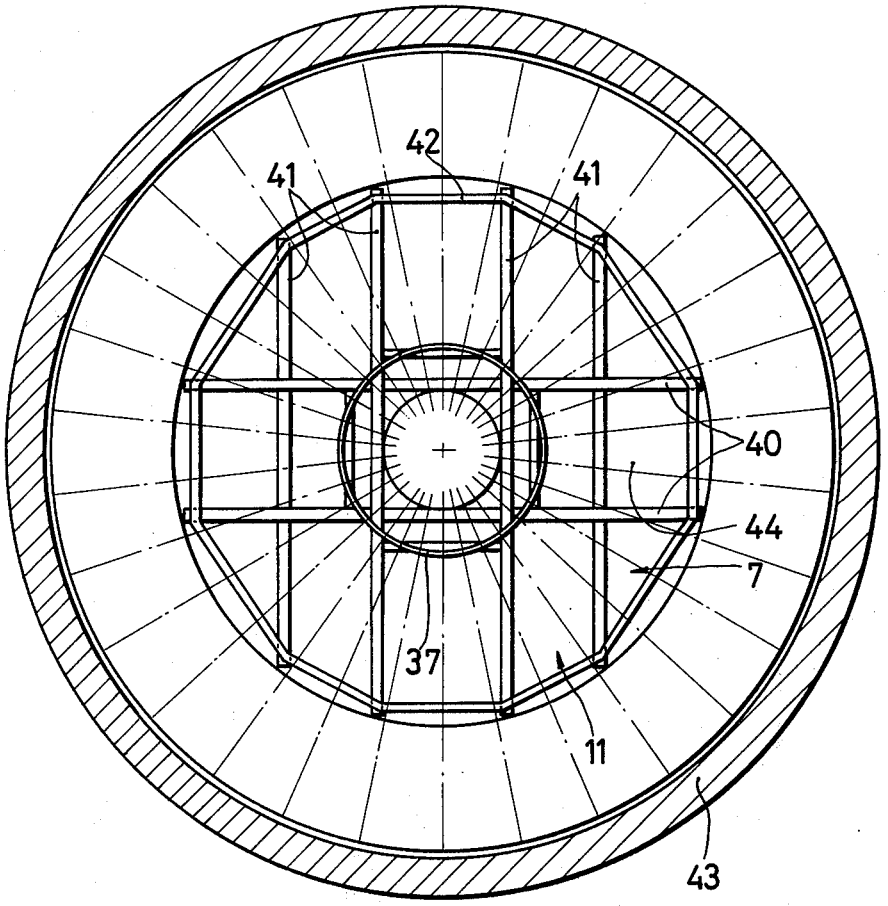
FIG. 4 is a top plan view of a carrying frame which can be used in both of the above-mentioned embodiments.

The construction of the liftable and dimensionally adjustable working platform 6 will now be discussed in connection with FIGS. 4 to 7. As illustrated in FIG. 4, profiled beams 40, together with further profiled beams 41 which extend substantially normal to the profiled beams 40, and also together with profiled beams 42 which interconnect the free ends of the profiled beams 40 and 41 with one another to form rectangular or polygonal outline, constitutes the carrier frame 7 which has been already mentioned in connection with FIG. 1. The reference numeral 43 indicates the cross-sectional area of the wall of the blast furnace. The components 12 are connected to the profiled beams in a conventional manner, such components first being illustrated in FIG. 1. The profiled beams 40, 41 and 42 are preferably welded to one another so as to obtain an extremely rigid construction. Profile beams 43 which together constitute a closed ring which is located concentrically within the polygon formed by the profiled beams 40, 41 and 42, are also advantageously welded to the profiled beams 40 and 41. The above-mentioned polygon and the above-mentioned closed ring form a carrying support for the outer parts 9 of the support elements 8, the latter extending in the radial directions of the working platform 6. This arrangement of the support elements 8 is diagrammatically illustrated in FIG. 5. The outer parts 9 circumferentially surround the supply opening 21 which has been discussed in connection with FIG. 2.

In the first embodiment of the present invention which is illustrated in FIG. 1, the opening 21 is covered by floor elements, while the opening 21 is not so covered in the embodiment illustrated in FIGS. 2 and 3.

As illustrated in FIG. 4, the floor 11 of the working platform 6 consists of a central portion 44 which is flush with the free ends of the profiled beams 40 and 41. Depending on the extent of a telescoping of the inner parts 10 of the support elements 8 out of the outer parts 9 thereof, one or more zones of floor elements or segments 45 are supported on the support elements 8 or the inner parts 10 thereof, the floor elements 45 being assembled with one another and with the support elements 8 to form an annular extension of the floor portion 11. In the embodiment which is illustrated in FIG. 5, there are provided two such zones of floor elements or segments 45 and 45', respectively.

Figure 5:
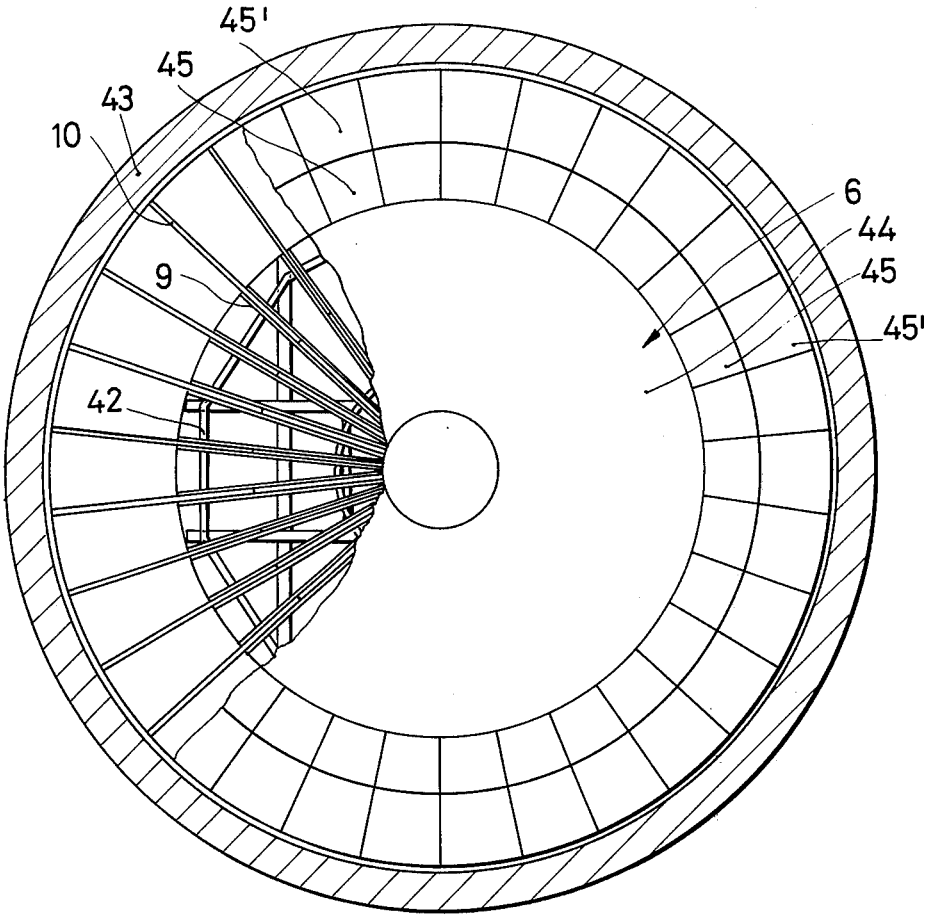
FIG. 5 is a top plan view of the arrangement of FIGS. 2 and 3.
Figure 6:
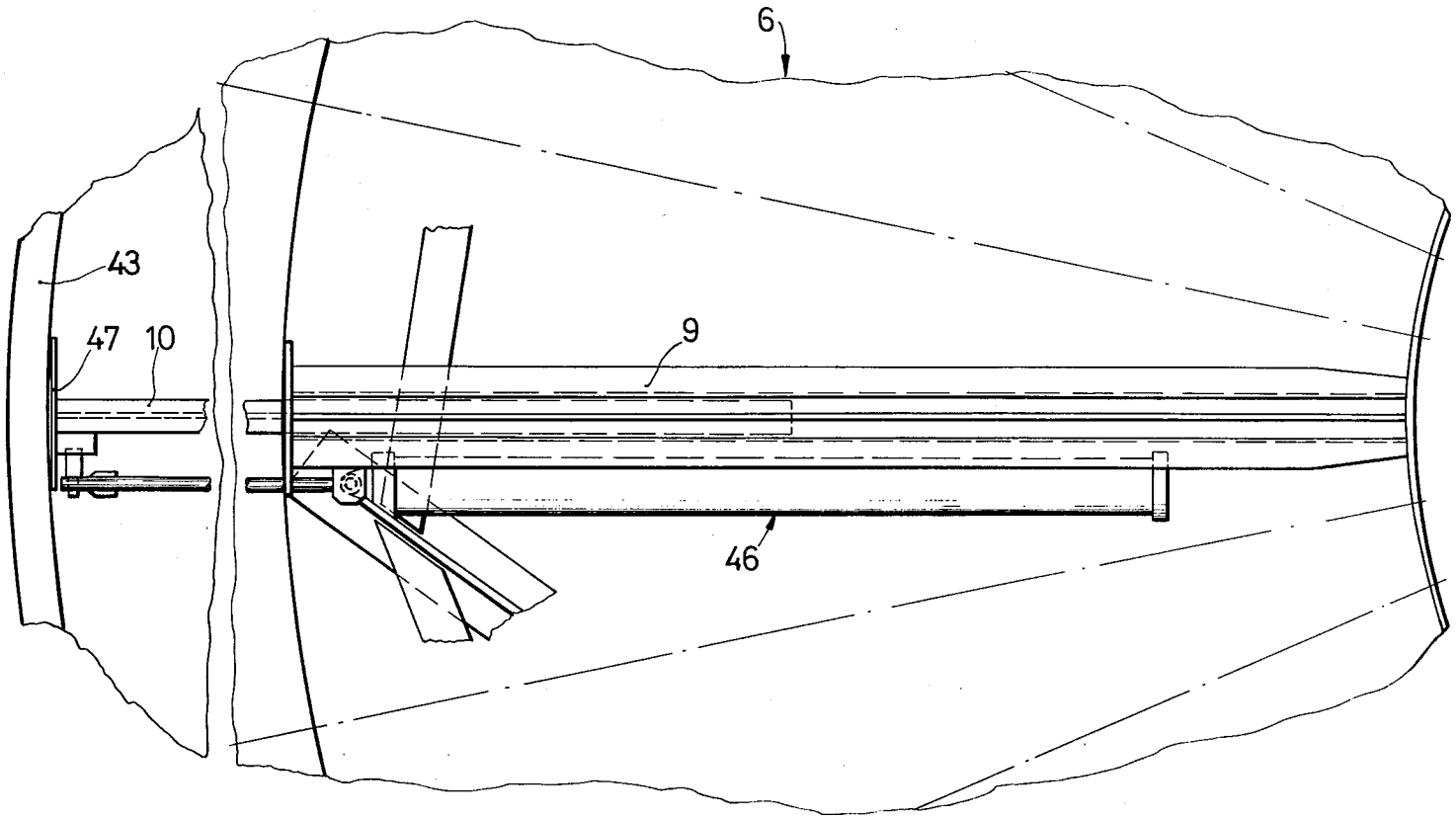
FIG. 6 is a partly fragmentary top plan view illustrating the arrangement of the support elements.

FIG. 6 illustrates a fragment of FIG. 5 in which most of the working platform 6 has been omitted. In order to telescope the support elements 8, a hydraulic cylinder-and-piston unit 46 is pivoted between the outer part 9 and the inner part 10 of the support element in question, each of such hydraulic cylinder-and-piston units 46 being capable of being operated independently of the other hydraulic cylinder-and-piston units 46. The respective inner parts 10 have free ends, and plates 47 can be mounted on such free ends which abut against the inner wall of the blast furnace.

Figure 7:
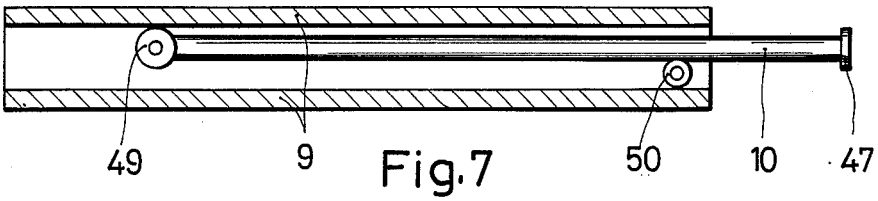
FIG. 7 is a longitudinal section through a diagrammatically illustrated support element.

FIG. 7 illustrates a longitudinal section through a diagrammatically illustrated support element 8. The inner part 10 has, at its end which is remote from the plate 47, a roller 49 by means of which it is guided in the interior of the outer part 9, and a further roller 50 is located at the outer end of the outer part 9 of the support element 8 which supports the respective inner part 10.

Figure 8:
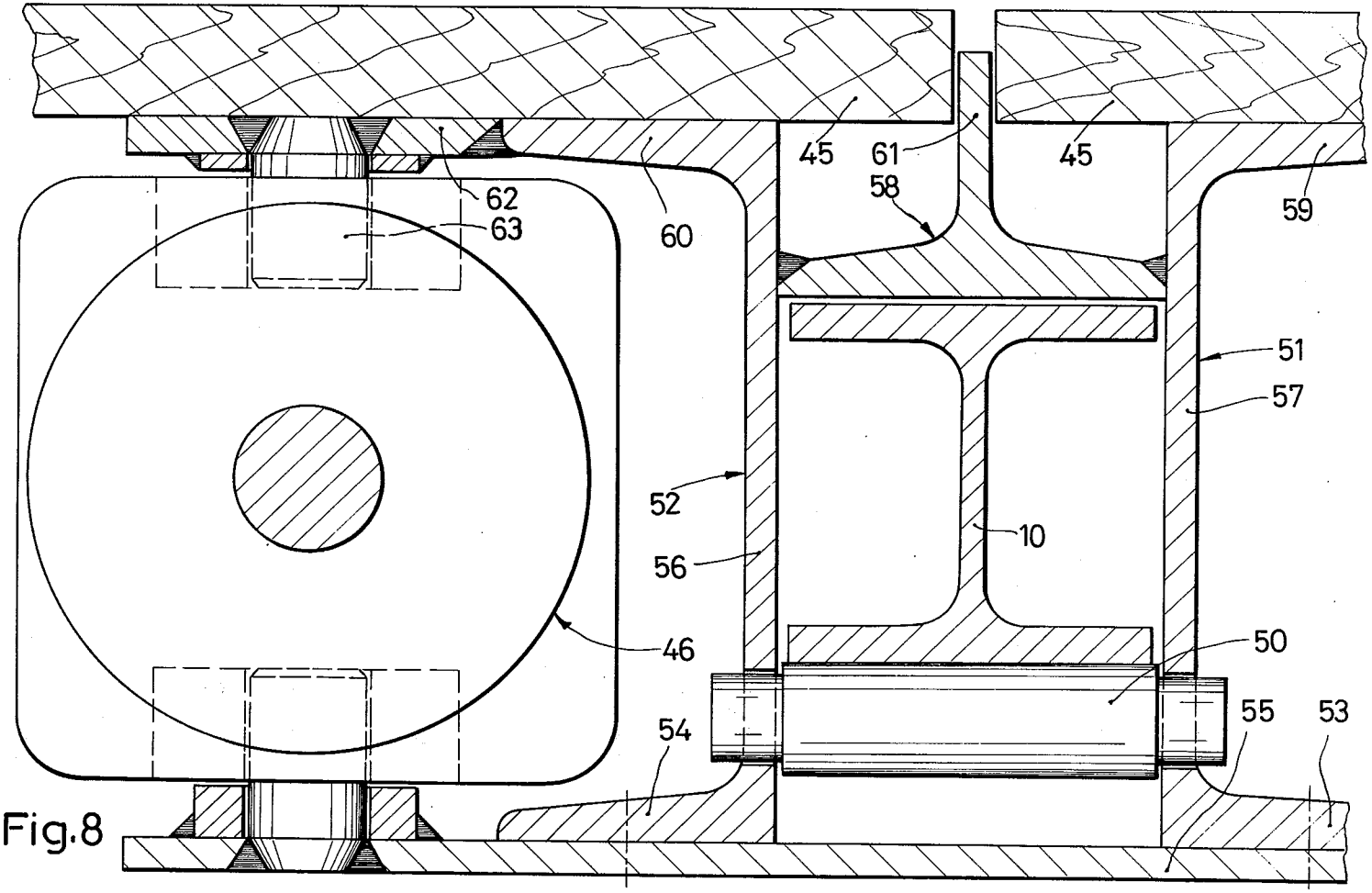
FIG. 8 is a front elevational view of a support element.

FIG. 8 illustrates a front elevational view of an example of the construction of the support element 8. The outer part 9 of the support element 8 includes two U-shaped beams 51 and 52 which have arms 53 and 54 which are supported on a plate 55. In the region of the front surface of the U-shaped beams 51 and 52, the roller 50 which is illustrated in FIG. 7 is mounted for rotation between the webs 56 and 57 of the U-shaped beams 51 and 52. The webs 56 and 57 which interconnect the respective arms 53 and 54 of the two U-shaped beams 51 and 52 are welded or otherwise connected to one another using a T-shaped beam 58 which is located in the regions of the upper arms of the U-shaped beams 51 and 52. The web 61 of the T-shaped beam 58 extends beyond the surface of the two arms of the U-shaped profiled beam pairs 51 and 52. The arm 60 is formed with an extension 62. A pivot 63 is mounted on the extension 62 and is aligned with a pivot 64 arranged on the plate 55, both of the pivots being located in the region of the opening 21 and each of them serving the purpose of connecting the hydraulic cylinder-and-piston unit 46 which is illustrated in the FIG. 6. The inner part 10 of the support element 8 is a profiled beam which has a shape of double T which is displaceably mounted in the outer part 9 by means of the roller 50, on the one hand, and by means of a roller 49 illustrated in FIG. 7 and which is mounted on the rear end of the double T profiled beam.

In this manner, the support elements 8 are united with their associated cylinder-and-piston units 46 into constructional units. The floor segments 45 and 45' and so on which can be seen in FIG. 5 rest on the arms 59 and 62 and are held in their respective positions by means of projecting webs 61. However, it is equally conceivable that the support elements 8 could be of circular cross-sections instead of cross-sections which have been just described.

It will be understood that each of the elements described above, or two or more together, may also find a useful application in other types of constructions differing from the types described above.

While the invention has been illustrated and described as embodied in an arrangement for lining blast furnaces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for lining a blast furnace of the type having an upright circumference wall and a closed top together bounding an interior of the blast furnace which has different transverse dimensions at different elevations of the blast furnace, comprising a working platform; means for introducing said working platform into the interior of the blast furnace, including an opening through a lower region of the circumferential wall of the blast furnace; means for lifting and lowering said working platform in the interior of the blast furnace between different elevations of the latter, including transversely aligned through openings at an upper region of the circumferential wall of the blast furnace below the closed top thereof, at least one support beam partly received in said through openings and extending transversely across the interior of the blast furnace, and means for suspending said working platform from said support beam for displacement toward and away from the latter; and means for adjusting the transverse dimensions of said working platform to those of the interior of the blast furnace at any particular elevation of the latter at which said working platform is located.

2. An arrangement as defined in claim 1, wherein said suspending means includes a plurality of tackles mounted on the working platform and on said support beam.

3. An arrangement as defined in claim 1, wherein said suspending means includes a plurality of winches mounted on said support beam and operative for taking up and paying out lifting cables which have portions connected to the working platform.

4. An arrangement as defined in claim 1, wherein said working platform includes a central portion; and wherein said adjusting means includes a plurality of support elements which are mounted in said central portion for telescopic displacement relative thereto toward and away from the circumferential wall of the blast furnace.

5. An arrangement as defined in claim 4, wherein said adjusting means further includes a plurality of floor elements which are interchangeably and detachably supported on said support elements when the latter are in their at least partly telescoped-out positions.

6. An arrangement as defined in claim 4, wherein said central portion of said working platform has a supply opening for supplying lining material to the working platform therethrough.

7. An arrangement as defined in claim 6; and further comprising a guiding sleeve located underneath said working platform and circumferentially surrounding said supply opening.

8. An arrangement as defined in claim 7, wherein said guiding sleeve conically diverges in the downward direction and bounds a frusto-conical passage for supply of the lining material therethrough, said passage guiding the lining material toward the supply opening of the working platform.

9. A method of lining a blast furnace of the type having an upright circumferential wall and a closed top together bounding an interior of the blast furnace which has different transverse dimensions at different elevations of the blast furnace, comprising the steps of providing an opening through a lower region of the blast furnace; introducing a working platform into the interior of the blast furnace through the opening; forming transversely aligned through openings at an upper region of the circumferential wall of the blast furnace below the closed top thereof; passing at least one support beam through said through openings to be partly received therein and to extend transversely across the interior of the blast furnace; suspending the working platform from the support beam for displacement toward and away from the latter; displacing the working platform to a particular working elevation; adjusting the transverse dimensions of the working platform to those of the interior of the blast furnace at the particular elevation of the latter; supplying lining material to the working platform through the opening in the lower region of the circumferential wall of the blast furnace; and erecting a lining at the circumferential wall of the blast furnace from the working platform utilizing the lining material.

10. A method as defined in claim 9, for use in a blast furnace having a worn-out lining; and further comprising the steps of disintegrating the worn-out lining from the working platform; and removing the disintegrated lining material from the interior of the blast furnace through the opening at the lower region of the circumferential wall of the blast furnace.

11. A method as defined in claim 9, wherein said supplying step further includes arranging the lining material on at least one pallet; supporting a winch of the support beam; connecting a lifting cable to the winch and to the pallet, and operating the winch to lift the pallet to the working platform for unloading and to subsequently lower the pallet.

12. A method as defined in claim 9; and further comprising the step of constructing a protective platform in the interior of the blast furnace subsequent to said displacing step and downwardly of the working platform to separate the interior of the blast furnace into an upper working zone in which the working platform is operated, and a lower working zone; building a lining in the lower zone using the protective platform; removing the protective platform; and completing the lining in a region of the circumferential wall previously juxtaposed with the protective platform.

* * * * *